US005565735A

United States Patent [19]

Takeji et al.

[11] Patent Number: 5,565,735

[45] Date of Patent: Oct. 15, 1996

[54] UNSATURATED VAPOR PRESSURE TYPE HIGH PRESSURE SODIUM LAMP

[75] Inventors: Yasaburo Takeji; Shinji Taniguchi, both of Kyoto, Japan

[73] Assignee: Japan Storage Battery Co., Ltd., Kyoto, Japan

[21] Appl. No.: 503,507

[22] Filed: Jul. 18, 1995

[30] Foreign Application Priority Data

Jul. 25, 1994 [JP] Japan ..... 6-193631

[51] Int. Cl.[6] ..... H01J 17/18

[52] U.S. Cl. ..... 313/623; 313/332

[58] Field of Search ..... 313/623, 624, 313/625, 332, 634

[56] References Cited

U.S. PATENT DOCUMENTS 4,742,269 5/1988 Izumiya et al. ..... 313/625

5,001,396 3/1991 Snellgrove et al. ..... 313/623

*Primary Examiner*—Sandra L. O'Shea

*Assistant Examiner*—Vip Patel

*Attorney, Agent, or Firm*—Sughrue, Mion, Zinn, Macpeak & Seas

[57] ABSTRACT

In an unsaturated vapor pressure type high sodium lamp, a glass solder used for closely sealing a cap to fix to an arc tube includes a first component which is a mixture of $Al_2O_3$, CaO and $Y_2O_3$, and a second component including at least one of $Sc_2O_3$, $La_2O_3$, $Sm_2O_3$, $Ce_2O_3$, $Yb_2O_3$ and $Dy_2O_3$; and a constant percentage of the second component in the glass solder is in a range of 2 to 15 weight %.

4 Claims, 1 Drawing Sheet

UNSATURATED VAPOR PRESSURE TYPE HIGH PRESSURE SODIUM LAMP

BACKGROUND OF THE INVENTION

1. Field of the Invention

The present invention relates to an improvement of an unsaturated vapor pressure type high pressure sodium lamp which substantially whole components filled within an arc tube are evaporated during the lighting thereof.

2. Description of the Related Art

Generally a high pressure sodium lamp has an arc tube and an outer tube installing the arc tube therein. A metallic cap having an electrode is inserted into both end openings of a translucent alumina tube as the arc tube and is closely sealed, and sodium, mercury and xenon gas is filled within the arc tube.

The lamp characteristic of the high pressure sodium lamp principally depends on the filling amount of sodium and mercury, the filling ratio of them and a position where surplus sodium and mercury stay during the lighting of the lamp, that is, the temperature of the coolest position in the arc tube. If sodium reacts with the component material of the arc tube, that is, if sodium is consumed the ratio of sodium and mercury is varied. Consequently, the characteristic of the lamp varied, especially, the voltage of the lamp increases to turn off it.

The conventional high pressure sodium lamp is a called saturated vapor pressure type high pressure sodium in which the excess amount of sodium extremely larger than the amount of sodium that vapors during the lighting is filled so as to compensate the consumption of the sodium. There is a little change in the characteristic of the high pressure sodium lamp, even if sodium is consumed during the lighting. However, with respect to the heat influence from the inside and outside, a little change of the temperature of the coolest position causes the extreme change of its lamp characteristic. Accordingly, the conventional high pressure sodium lamp has a large temperature dependency.

On the other hand, in a case where the whole amount of filled sodium and mercury have vapored during the lighting, since the filled materials for vapor do not exist any longer, the vapor pressure no longer increases. Accordingly, even if the temperature of the coolest position is changed, its lamp characteristic is almost never changed. The lamp having such an excellent characteristic is a well-known unsaturated vapor pressure type high pressure sodium lamp.

However, the arc tube of the unsaturated vapor pressure type high pressure sodium lamp is filled with sodium whose amount is only for vaporing during the lighting. Accordingly, if sodium reacts with the component material of the arc tube, the consumption of the sodium appears as the change of its lamp characteristic. Therefore, in order to accomplish the unsaturated vapor pressure type high pressure sodium lamp, sodium have to be prevented from the reaction with the component material of the arc tube. Consequently, at present, due to the difficulty of the prevention of the reaction, the unsaturated vapor pressure type high pressure sodium lamp is still not made fit for practical use.

SUMMARY OF THE INVENTION

It is an object of the present invention to provide an unsaturated vapor pressure type high pressure sodium lamp which is free from the consumption of sodium due to the reaction of sodium and the component material of the arc tube, and has an excellent lamp life characteristic.

The unsaturated vapor pressure type high pressure sodium lamp according to the present invention is comprised of: an arc tube comprising a translucent alumina tube having both end opening portions; a niobium cap having an electrode which is inserted into both end portions of the arc tube; a glass solder for closely sealing to fix the niobium cap to the arc tube; and xenon gas, mercury and sodium filled within the arc tube, substantially whole of the mercury and sodium being evaporated during the lighting of the lamp; wherein the glass solder comprising a first component which is a mixture of $Al_2O_3$, CaO and $Y_2O_3$, and a second component comprising at least one compound selected from the group consisting of $Sc_2O_3$, $La_2O_3$, $Sm_2O_3$, $Ce_2O_3$, $Yb_2O_3$ and $Dy_2O_3$, a constant percentage of the second component in the glass solder being in a range of 2 to 15 weight %.

The glass solder having the above structure is free from the reaction with sodium, thereby consuming no sodium. Accordingly, the unsaturated vapor pressure type high pressure sodium lamp having an excellent life characteristic without decreasing the lamp voltage can be realized.

BRIEF DESCRIPTION OF THE DRAWINGS

In the accompanying drawings.

DETAILED DESCRIPTION OF THE INVENTION

The detailed description of the present invention will be described as follows referring to the accompanying drawings.

Figure 1:
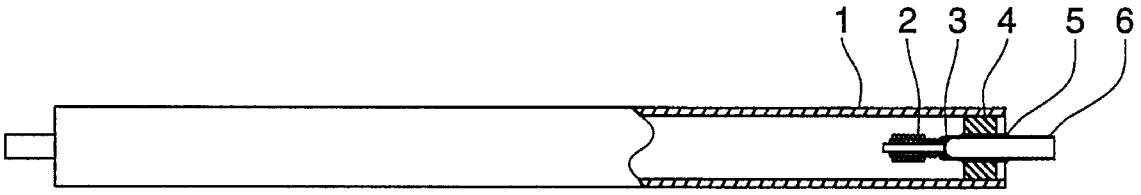
FIG. 1 is a sectional view showing an embodiment of an arc tube of an unsaturated vapor pressure type high pressure sodium lamp according to the present invention.
Figure 2:
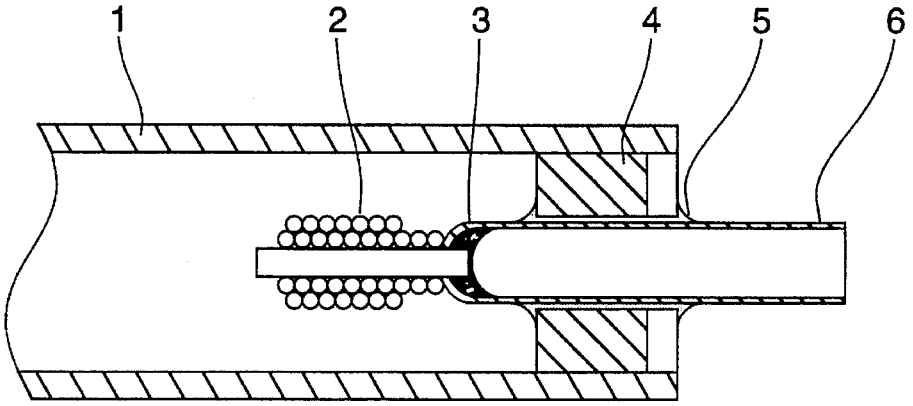
FIG. 2 is an enlarged view of the main portion of the unsaturated vapor pressure type high pressure sodium lamp in FIG. 1.

FIGS. 1 and 2 shows one embodiment of an unsaturated vapor pressure type high pressure sodium lamp according to the present invention. This embodiment employs a 360 W lamp. In FIG. 1, reference numeral 1 represents a translucent alumina tube having an inner diameter of 8.0 mm and a total length of 118 mm. An alumina ceramic disk 4 is integrally sintered and fixed to both end portions of the translucent alumina tube 1. A heat resistant metallic exhaust tube 6 made of Nb-1% Zr having an outer diameter of 3.0 mm, thickness of 0.25 mm and length of 15 mm penetrating through the center opening portion of the alumina ceramic disk 4 is soldered thereto by a glass solder 5. The heat resistant metallic exhaust tube 6 has an electrode 2 at the top end portion thereof fixed by a titanium wax 3. Xenon gas under the pressure of $3.3\times10^4$ Pa in the room temperature, sodium being 0.055 mg in weight and mercury being 4.5 mg in weight are filled within thus closely sealed translucent alumina arc tube. The arc tube thus constructed is stored in an outer bulb (not shown) to accomplish the lump.

The present inventors conducted the following preliminary experimentations which were conducted under the same condition except that the following glass solders No. 1 to No. 4 were used to produce lamps. These lamps were subjected to lighting examination under a lamp power of 360 W. Results of these examinations are indicated in Table 1. The value of a lamp voltage falling in Table 1 is a difference between the value of an initial lamp voltage and a lamp voltage after lighting the lamp for predetermined time. Respective values indicated in Table 1 are the mean values of five lamps.

| | |
|---|---|
| (1) glass solder No. 1 | |
| $Al_2O_3$ | 46.0 wt % |
| CaO | 42.0 wt % |
| $Y_2O_3$ | 3.0 wt % |
| SrO | 9.0 wt % |
| (2) glass solder No. 2 | |
| $Al_2O_3$ | 46.0 wt % |
| CaO | 42.0 wt % |
| $Y_2O_3$ | 3.0 wt % |
| SrO | 8.0 wt % |
| $Sc_2O_3$ | 1.0 wt % |
| (3) glass solder No. 3 | |
| $Al_2O_3$ | 46.0 wt % |
| CaO | 42.0 wt % |
| $Y_2O_3$ | 3.0 wt % |
| SrO | 1.0 wt % |
| $Sc_2O_3$ | 8.0 wt % |
| (4) glass solder No. 4 | |
| $Al_2O_3$ | 46.0 wt % |
| CaO | 42.0 wt % |
| $Y_2O_3$ | 3.0 wt % |
| $Sc_2O_3$ | 9.0 wt % |

TABLE 1

| GLASS SOLDER | LAMP VOLTAGE FALLING AFTER 1,000 HOURS | LAMP VOLTAGE FALLING AFTER 2,000 HOURS | LAMP VOLTAGE FALLING AFTER 5,000 HOURS |
|---|---|---|---|
| No. 1 | 2.2 V | 5.7 V | 12.3 V |
| No. 2 | 2.1 V | 5.2 V | 11.4 V |
| No. 3 | 1.5 V | 4.1 V | 10.6 V |
| No. 4 | 0.6 V | 1.3 V | 2.5 V |

In view of the above results of the preliminary experimentations, the following facts were found out.

1. The glass solder including SrO consumes the large amount of sodium.

2. The glass solder including $Sc_2O_3$ in place of SrO (not including SrO) consumes no sodium.

Consequently, it was found out that one kind of oxide was preferably added in place of SrO in order to prevent the reaction of sodium and the glass solder. In accordance with these results, the same experimentation was conducted to various kinds of oxides, and the following results were found out.

3. Oxide used in place of SrO which consumed the large amount of sodium was $Li_2O$, BaO, $Na_2O$ or the like.

4. Oxide used in place of SrO which consumed no sodium was $La_2O_3$, $Sm_2O_3$, $Dy_2O_3$, $Ce_2O_3$, $Yb_2O_3$ or the like.

Lamps using glass solders of the following examples 1 to 8 were produced. These lamps were subjected to the lighting examinations, and the lamp voltage falling of each lamp per 1,000 hours were less than 1.0 V, thereby having an excellent life characteristic.

EXAMPLE 1

An unsaturated vapor pressure type high pressure sodium lamp includes a glass solder having a first component including a mixture of:

| | |
|---|---|
| $Al_2O_3$ | 50.5 wt %, |
| CaO | 46.2 wt %, and |
| $Y_2O_3$ | 3.3 wt %; and |
| a second component including | |
| $Sc_2O_3$ | 100 wt %; |

wherein the percentage content of the second component in the glass solder is 2 wt %.

EXAMPLE 2

An unsaturated vapor pressure type high pressure sodium lamp includes a glass solder having first component including a mixture of:

| | |
|---|---|
| $Al_2O_3$ | 50.5 wt %, |
| CaO | 46.2 wt %, and |
| $Y_2O_3$ | 3.3 wt %; and |
| a second component including | |
| $Sc_2O_3$ | 100 wt %; |

wherein the percentage content of the second component in the glass solder is 6 wt %.

EXAMPLE 3

An unsaturated vapor pressure type high pressure sodium lamp includes a glass solder having a first component including a mixture of:

| | |
|---|---|
| $Al_2O_3$ | 50.5 wt %, |
| CaO | 46.2 wt %, and |
| $Y_2O_3$ | 3.3 wt %; and |
| a second component including | |
| $Sc_2O_3$ | 100 wt %; |

wherein the percentage content of the second component in the glass solder is 10 wt %.

EXAMPLE 4

An unsaturated vapor pressure type high pressure sodium lamp includes a glass solder having a first component including a mixture of:

| | |
|---|---|
| $Al_2O_3$ | 50.5 wt %, |
| CaO | 46.2 wt %, and |
| $Y_2O_3$ | 3.3 wt %; and |
| a second component includes | |
| $Sc_2O_3$ | 100 wt %; |

wherein the percentage content of the second component in the glass solder is 15 wt %.

EXAMPLE 5

An unsaturated vapor pressure type high pressure sodium lamp includes a glass solder having a first component including a mixture of:

| | |
|---|---|
| $Al_2O_3$ | 50.5 wt %, |
| CaO | 46.2 wt %, and |
| $Y_2O_3$ | 3.3 wt %; and |
| a second component including | |
| $Sc_2O_3$ | 50 wt %, |
| $Dy_2O_3$ | 50 wt %; and |

wherein the percentage content of the second component in the glass solder is 9 wt %.

EXAMPLE 6

An unsaturated vapor pressure type high pressure sodium lamp includes a glass solder having a first component including a mixture of:

| | |
|---|---|
| $Al_2O_3$ | 50.5 wt %, |
| CaO | 46.2 wt %, and |
| $Y_2O_3$ | 3.3 wt %; and |
| a second component including | |
| $Sc_2O_3$ | 33.3 wt %, |
| $Dy_2O_3$ | 33.3 wt %, and |
| $Ce_2O_3$ | 33.3 wt %; |

wherein the percentage content of the second component in the glass solder is 9 wt %.

EXAMPLE 7

An unsaturated vapor pressure type high pressure sodium lamp includes a glass solder having a first component including a mixture of:

| | |
|---|---|
| $Al_2O_3$ | 50.5 wt %, |
| CaO | 46.2 wt %, and |
| $Y_2O_3$ | 3.3 wt %; and |
| a second component including | |
| $Sc_2O_3$ | 25.0 wt %, |
| $Dy_2O_3$ | 25.0 wt %, |
| $Ce_2O_3$ | 25.0 wt %, and |
| $La_2O_3$ | 25.0 wt %; |

wherein the percentage content of the second component in the glass solder is 9 wt%.

EXAMPLE 8

An unsaturated vapor pressure type high pressure sodium lamp includes a glass solder having a first component including a mixture of:

| | |
|---|---|
| $Al_2O_3$ | 50.5 wt %, |
| CaO | 46.2 wt %, and |
| $Y_2O_3$ | 3.3 wt %; |
| a second component including | |
| $Sc_2O_3$ | 20.0 wt %, |
| $Dy_2O_3$ | 20.0 wt %, |
| $Ce_2O_3$ | 20.0 wt %, |
| $La_2O_3$ | 20.0 wt %, and |
| $Sm_2O_3$ | 20.0 wt %; |

wherein the percentage content of the second component in the glass solder is 9 wt %.

Incidentally, conditions which the glass solder should have are the melting point equal to or less than 1450° C., and the coefficient of thermal expansion approximate to that of the alumina tube. However, in a case where the first component is out of the following range:

| | |
|---|---|
| $Al_2O_3$ | 40 to 60 wt % |
| CaO | 40 to 60 wt % |
| $Y_2O_3$ | 1 to 6 wt %; and |

in a case where the percentage content of the second component in the glass solder is out of the range of 2 to 15 wt %, the glass solder having such a feature is not practicable because the melting point of the glass solder excesses 1,450° C. and/or its coefficient of thermal expansion is not approximate to that of the alumina tube.

As described above, the unsaturated vapor pressure type high pressure sodium lamp of the present invention wherein a niobium cap having an electrode is inserted into both end openings of an arc tube comprising a translucent alumina tube and is closely sealed, and the arc tube is filled with xenon gas, mercury and sodium, the substantially whole amount of the mercury and sodium evaporating during the lighting of the lamp; is characterized in that: the glass solder comprising a first component which is a mixture of $Al_2O_3$, CaO and $Y_2O_3$, and a second component comprising at least one compound selected from the group consisting of $Sc_2O_3$, $La_2O_3$, $Sm_2O_3$, $Ce_2O_3$, $Yb_2O_3$ and $Dy_2O_3$; and a constant percentage of the second component in the glass solder is in a range of 2 to 15 weight %. Therefore, sodium is free from the reaction with the glass solder, and sodium is not consumed during the lighting of the lamp, thereby providing the unsaturated vapor type high pressure sodium lamp having the excellent life characteristic.

What is claimed is:

1. An unsaturated vapor pressure type high pressure sodium lamp comprising:

an arc tube comprising a translucent alumina tube having both end opening portions;

a niobium cap having an electrode which is inserted into both end portions of said arc tube;

a glass solder for closely sealing to fix said niobium cap to said arc tube; and xenon gas, mercury and sodium filled within said arc tube, substantially whole of the mercury and sodium being evaporated during the lighting of said lamp;

wherein said glass solder comprising a first component which is a mixture of $Al_2O_3$, CaO and $Y_2O_3$, and a second component comprising at least one compound selected from the group consisting of $Sc_2O_3$, $La_2O_3$, $Sm_2O_3$, $Ce_2O_3$, $Yb_2O_3$ and $Dy_2O_3$, a constant percentage of said second component in said glass solder being in a range of 2 to 15 weight %.

2. An unsaturated vapor pressure type high pressure sodium lamp according to claim 1, wherein said first component of said glass solder includes $Al_2O_3$ in a range of 40 to 60 weight %, CaO in a range of 40 to 60 weight % and $Y_2O_3$ in a range of 1 to 6 weight %.

3. An unsaturated vapor pressure type high pressure sodium lamp according to claim 1, wherein a melting point of said glass solder is equal to or less than 1450° C.

4. An unsaturated vapor pressure type high pressure sodium lamp according to claim 1, wherein a coefficient of thermal expansion of said glass solder is substantially equal to said arc tube.

* * * * *